US006922999B2

(12) United States Patent
Kimura et al.

(10) Patent No.: US 6,922,999 B2
(45) Date of Patent: Aug. 2, 2005

(54) SINGLE-WINDING MULTI-STAGE SCROLL EXPANDER

(75) Inventors: Hideyuki Kimura, Yokohama (JP); Yutaka Kenmochi, Yokohama (JP)

(73) Assignee: Anest Iwata Corporation (JP)

( * ) Notice: Subject to any disclaimer, the term of this patent is extended or adjusted under 35 U.S.C. 154(b) by 7 days.

(21) Appl. No.: 10/382,006

(22) Filed: Mar. 5, 2003

(65) Prior Publication Data

US 2004/0172945 A1 Sep. 9, 2004

(51) Int. Cl.[7] ..... F04C 17/02; F04C 23/00; F04C 18/04; F01C 1/04; F01C 11/00

(52) U.S. Cl. ..... 60/643; 60/679; 418/6; 418/55.1; 418/59; 418/60

(58) Field of Search ..... 60/643, 679; 418/55.1, 418/55.2, 55.3, 55.4, 55.5, 55.6, 6, 58, 59, 60

(56) References Cited

U.S. PATENT DOCUMENTS

| | | | | | |
|---|---|---|---|---|---|
| 4,141,677 | A | * | 2/1979 | Weaver et al. | 418/6 |
| 4,157,234 | A | * | 6/1979 | Weaver et al. | 418/6 |
| 6,659,743 | B2 | * | 12/2003 | Kimura et al. | 418/6 |
| 6,682,328 | B2 | * | 1/2004 | Kimura et al. | 418/6 |
| 6,709,248 | B2 | * | 3/2004 | Fujioka et al. | 418/59 |
| 6,736,620 | B2 | * | 5/2004 | Satoh | 418/6 |

* cited by examiner

*Primary Examiner*—Sheldon J Richter

(57) ABSTRACT

A single-winding multi-stage expander comprises a fixed scroll and an orbiting scroll which revolves eccentrically with respect to the fixed scroll so as to pressurize a sealed chamber formed between the two scrolls to drive a crankshaft. A high-temperature pressurized gas is introduced into a first-stage inner division and sent to an external heater. The heated gas is sent back to a second-stage outer division of the expander to significantly increase efficiency thereof.

2 Claims, 2 Drawing Sheets

SINGLE-WINDING MULTI-STAGE SCROLL EXPANDER

BACKGROUND OF THE INVENTION

The present invention concerns a single-winding multi-stage scroll expander by which utilizable rotational force is effectively obtained by a wasted high-temperature steam in areas where heating steam is used, such as the Northern part of North America or Northern Europe.

Expanders for driving an electric generator include a turbine-type, a screw-type, a vane-type and a scroll-type.

To drive a relatively low-output generator, the turbine-type is weak against water, the screw-type is difficult to reduce in size and weight, and the vane-type is not sufficiently durable.

The scroll-type is most suitable as a small-sized, light, durable expander, a fact acknowledged among learned engineers.

The simplest scroll expander in structure comprises a single winding. A high-temperature, high-pressure gas such as air or vapor is fed through the center of a wrap. Expansion of the gas in the expander is converted into rotation of a crankshaft to drive an electric generator. Specifically, the scroll expander is an energy converting device transforming heat energy into kinetic energy.

An expander would provide the maximum or 100% energy conversion efficiency if a pressurized gas in an expansion process was converted under constant entropy or reversible adiabatic change.

However, in an actual scroll expander, high-pressure gas heat is partially lost during the expansion process through the wall of the expander due to heat conduction. The maximum conversion efficiency from thermal energy into kinetic energy is actually about 60%.

According to the inventors' experiments, the polytropic index in the expansion process is about 1.1 when compressed air is used as operating fluid. As the adiabatic index of air is 1.4, the difference translates into heat loss.

Therefore, to improve performance of an expander to increase efficiency, it is important how to reduce heat or internal energy loss during the expansion process. However, it is practically difficult for an expansion chamber to be made of complete adiabatic material, thereby limiting improvement in the performance of the expander.

SUMMARY OF THE INVENTION

It is an object of the present invention to provide a single-winding multi-stage scroll expander which is relatively simple, small-sized, light and durable to increase energy conversion efficiency.

BRIEF DESCRIPTION OF THE DRAWINGS

The features and advantages of the present invention will become more apparent from the following description with respect to an embodiment as shown in appended drawings wherein.

DETAILED DESCRIPTION OF PREFERRED EMBODIMENT

Figure 1:
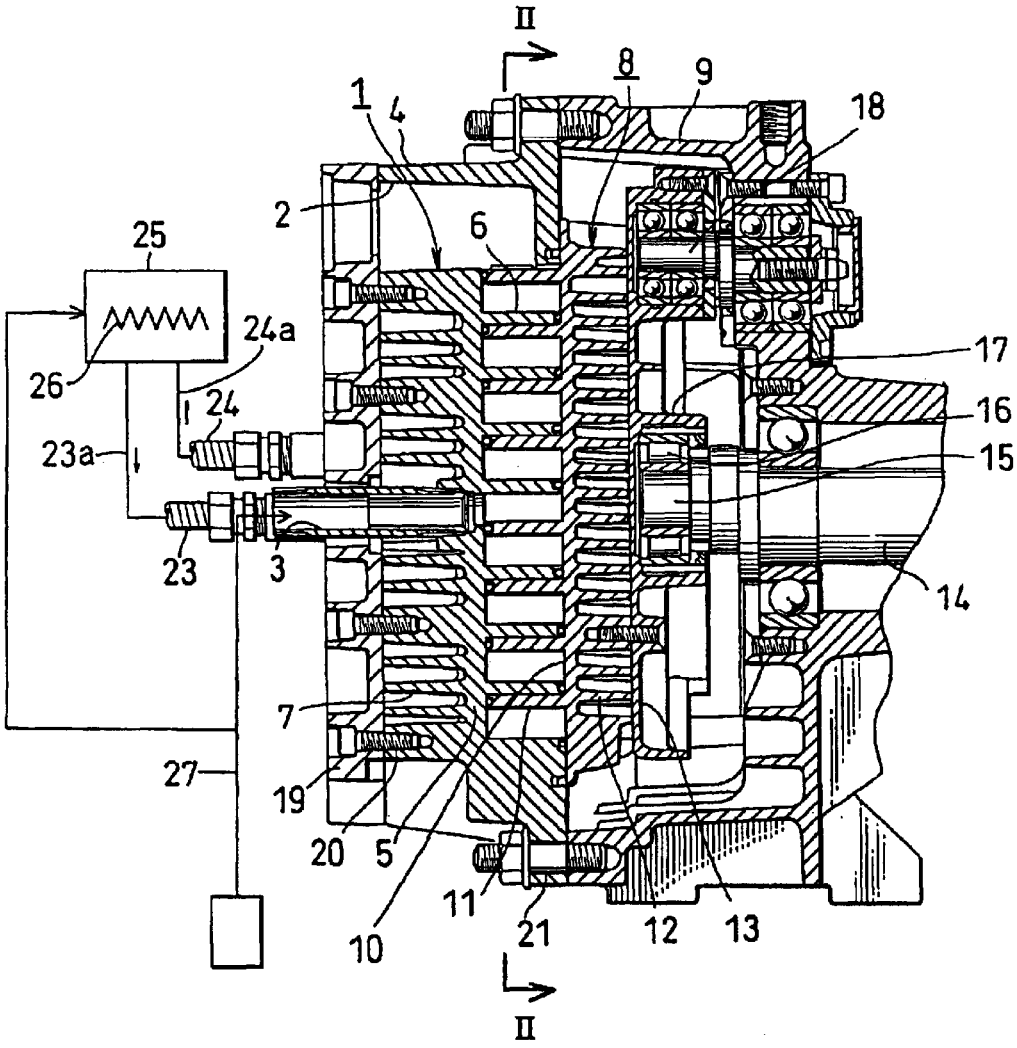
FIG. 1 is a vertical sectional side view of one embodiment of the present invention.

As known among persons skilled in the art, a scroll expander means an energy converting mechanism for converting heat energy into kinetic energy in which a high-pressure gas such as air or vapor is fed through the center of a wrap of a fixed or orbiting scroll such that expansion of the high-pressure gas in the expander is converted to rotation of a driving shaft integrally formed with a crankshaft to produce electricity.

A single-winding two-stage scroll expander as one example of a multi-stage scroll expander will be described with respect to FIGS. 1 and 2. The present invention may be applied to scroll expanders of more than two stages as well.

A fixed scroll 1 comprises a fixed scroll housing 4 which has a second-stage outlet 2 on the outer portion and a first-stage inlet 3 at the center; a fixed end plate 5 integrally formed with the housing 4; a spiral fixed wrap 6 on the front surface of the fixed end plate 5; and a plurality of cooling fins 7 having the same height and equidistant to each other on the rear surface.

An orbiting scroll 8 which faces the front face of the fixed scroll 1 has a spiral orbiting wrap 11 on the front surface of a circular orbiting end plate 10 in a drive shaft housing 9, or on the surface opposing the fixed scroll 1, and a plurality of cooling fins 12 having the same height and equidistant to each other on the rear surface.

A bearing plate 13 is fixed on the rear surface of the orbiting scroll 8.

A tubular boss 17 is projected at the center of the rear surface of the bearing plate 13 or the surface opposite the orbiting scroll 8, and a crankshaft 15 integrally formed with a drive shaft 14 in the tubular boss 17 is rotatably mounted via a bearing 16.

A rotation preventing mechanism 18 such as a known crank pin is provided on the outer portion of the bearing plate 13, and the orbiting scroll 8 revolves eccentrically with respect to the drive shaft housing 9 to form a sealed chamber between the fixed scroll 1 and the orbiting scroll 8.

A pressing plate 19 is fastened by a fastening screw 20 on the rear surface of the fixed scroll 1 or the surface opposite the orbiting scroll 8.

The front surface of the bearing plate 13 is engaged on the rear surface of the orbiting scroll 8, so that the fixed scroll 1 is integrally formed with the drive shaft housing 9 with a fastening screw 21 to constitute a single-winding two-stage scroll expander.

Figure 2:
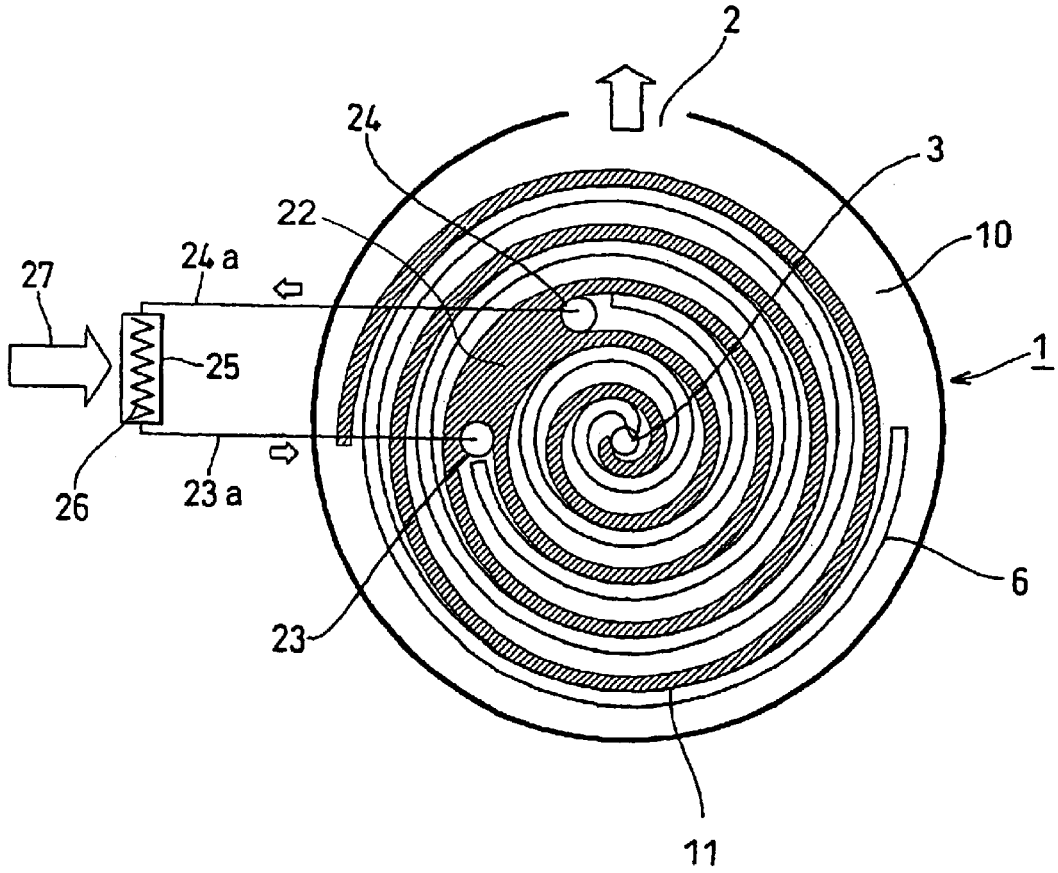
FIG. 2 is a vertical sectional view taken along the line II—II in FIG. 1.

In the single-winding two-stage scroll expander, as shown in FIG. 2, a low pressure stage division which is an outer portion of the fixed scroll 1 and the orbiting scroll 8 or winding-end portion or outer portion of the fixed wrap 6 is clearly separated from a high-pressure stage division which is an inner portion of the scrolls 1,8 or winding-beginning portion or inner portion of the fixed wrap 6.

A partition wall 22 for blocking a fluid path of a pressurized gas is provided integrally with the fixed end plate 5 in the middle of the fixed wrap 6, and on the side surface of the partition wall 22, a second-stage inlet 23 is provided which interfaces with the winding-end portion of the fixed wrap 6 and penetrates axially through the fixed plate 5, and a first-stage outlet 24 is provided which interfaces with the winding beginning portion of the fixed wrap 6 and penetrates axially through the fixed end plate 5.

As shown in FIG. 1, the second-stage inlet 23 is connected to an outlet of a heater 25 via a conduit 23*a*, and the first-stage outlet 24 is connected to an inlet of the heater 25 via a conduit 24*a*.

As shown in FIG. 1, the heater 25 includes an electric heater 26 and is also connected to a pressurized gas 27 which is forwarded to the first-stage inlet 3 so that the gas is partially sent to the heater 25, heated thereby and sent to the low-pressure stage division through the second-stage inlet 23. The heater 23 may be either of them.

The high-temperature pressurized gas 27 is passed into the scroll expander through the first-stage inlet 3 and expansion occurs, thereby orbiting the orbiting scroll 8 to drive the drive shaft 14 via the crankshaft 15 enabling a generator (not shown) to be driven.

When temperature and pressure of the pressurized gas 27 decrease in the scroll expander during operation, the high-pressure gas which escapes from the first-stage outlet 24 is heated by the heater 25 to flow into the scroll expander via the second-stage inlet 23 thereby allowing the drive shaft to be effectively driven without decreasing output.

In the single-winding expander according to the present invention, the heated gas of which temperature decreases in the expanded gas circuits is subsequently reheated by the electric heater or fed pressurized gas, and thereafter is utilized to generate power, thereby significantly increasing efficiency of the scroll expander.

The foregoing merely relates to an embodiment of the invention. Various changes and modifications may be made by persons skilled in the art without departing from the scope of claims.

What is claimed is:

1. A single-winding multi-stage scroll expander comprising:

a fixed scroll comprising a fixed end plate having a spiral fixed wrap;

an orbiting scroll comprising an orbiting end plate having a spiral orbiting wrap opposite to the fixed wrap to define a sealed chamber between the fixed wrap and the orbiting wrap;

a crankshaft to which the orbiting scroll is connected to be able to revolve eccentrically with respect to the fixed scroll so that the crankshaft may rotate; and a first-stage inner division and a second-stage outer division being formed in the sealed chamber between said fixed and orbiting scrolls, said first-stage inner division having at the center of the fixed scroll a first-stage inlet through which a high-temperature pressurized gas comprising wasted high-temperature steam is introduced and a first-stage outlet at a radially outer position, said second-stage outer division having a second-stage inlet near the first-stage outlet and a second-stage outlet at a radially outer position than the second-stage inlet to discharge the gas, said scroll expander further comprising a heater between the first-stage outlet and the second-stage inlet, said high-temperature pressurized gas introduced through the first-stage inlet being able to be partially applied as heating source by said heater, the gas forwarded from the first-stage outlet being heated and pressurized by said heater so that the gas is introduced into said second-stage inlet of the second-stage outer division thereby increasing efficiency of the single-winding multi-stage scroll expander.

2. An expander as claimed in claim 1 wherein the heater is an electric heater.

* * * * *